US005425541A

United States Patent [19]

Ambros

[11] Patent Number: 5,425,541

[45] Date of Patent: Jun. 20, 1995

[54] LACROSSE STICK POCKET FORMER

[76] Inventor: Matthew Ambros, 7 Bridgmen Rd., Hanover, N.H. 03755

[21] Appl. No.: 311,965

[22] Filed: Sep. 26, 1994

[51] Int. Cl.[6] ..... A63B 59/02

[52] U.S. Cl. ..... 273/326; 100/289

[58] Field of Search ..... 273/326, 73 B, 73 L, 273/74; 26/1, 51; 81/485; 100/289, 295

[56] References Cited

U.S. PATENT DOCUMENTS

| | | | |
|---|---|---|---|
| 809,882 | 1/1906 | Wrigley | 273/73 B X |
| 1,612,109 | 12/1926 | Flower | 273/74 |
| 3,474,509 | 10/1969 | Bray | 26/51 |
| 4,153,251 | 5/1979 | Pond | 273/326 |
| 4,809,567 | 3/1989 | Bongard | 81/485 |
| 5,048,843 | 9/1991 | Dorfi et al. | 273/326 |

*Primary Examiner*—William H. Grieb

[57] ABSTRACT

A typical embodiment of the device consists of a convex form (for example, a hemisphere of radius similar in size to a lacrosse ball) connected to a bracing crosspiece by a threaded screw shaft. The form is attached to one end of the shaft, the bracing crosspiece is threaded onto the shaft, and a knob is affixed to the other end of the shaft. The device is used by placing the bracing crosspiece across the lacrosse head with the ends of the crosspiece under opposite sidewalls, and tightening the form against the stringing to the desired depth by twisting the knob and thereby screwing the threaded shaft through the crosspiece. The invention provides a means of forming and maintaining a pocket in new stringing at a chosen position along the length of the head and to a desired depth. A single crosspiece of variable length, or interchangeable crosspieces of various fixed lengths may be used to accommodate different lacrosse head widths.

13 Claims, 6 Drawing Sheets

LACROSSE STICK POCKET FORMER

BACKGROUND-FIELD OF INVENTION

This invention relates to the preparation of a lacrosse stick for play, specifically to means and methods for pressing a pocket into the stringing of the lacrosse stick head.

BACKGROUND-DESCRIPTION OF PRIOR ART

The "stringing" of a lacrosse stick is the net-like webbing in the stick head. The ball rests against the stringing while the player is running or throwing the ball. Effective use of the lacrosse stick requires that the stringing contain a pocket, or depression, in which the ball can rest before being thrown. The pocket may be anywhere within the stringing, depending on the player's preference, but, according to regulations, must be no deeper than one ball diameter below the bottom of the sidewalls of the head. The stringing is usually woven by hand, and may be replaced often, depending on the requirements and preferences of the player. It is often desirable or necessary to introduce a pocket into newly-strung stringing, or to alter the position of the pocket within old stringing.

Prior to this invention, there had been no machine for pressing, or forming, a pocket in pre-existing lacrosse stick stringing. Players usually attempted to form a pocket by pressing a ball into the stringing by hand, and/or by applying weights to the stringing, or by using miscellaneous articles such as sticks or kitchen utensils to wedge a ball into the stringing. These previous methods are unsatisfactory because a) they often require multiple objects that are not always readily available in combination; b) the objects employed are not connected together in a manner suited for their application to lacrosse stick pocket forming and c) these other methods do not involve mechanisms or means to apply and maintain a controlled forming pressure at a specified location, and to a specified depth in the stringing.

OBJECTS OF THE INVENTION

The advantages of the present invention are:

a) to form a pocket at any desired location in the stringing by the use of a simple, self-contained device;

b) to form a pocket of desired (and regulation) depth by the application of a controlled pressure against the stringing;

c) to maintain the position and depth of the pocket by storing the lacrosse stick with the forming device in place.

DRAWING FIGURES

FIG. 1. ½ scale. Side view of pocket former. A convex form 1, in this case a hemisphere, is shown in cutaway to display the manner of attachment of the form to a connecting mechanism, here a threaded screw shaft 2; the shaft is machined to fit snugly into a hole in the center of the back face of the form. A knob 3 is affixed to the other end of the shaft, and is used to screw the shaft and form through a bracing crosspiece 4, which is drilled and tapped to accept the thread of the shaft.

FIG. 2. ½ scale. Top view of the pocket former and lacrosse stick head showing the manner of placement of the crosspiece 4 with respect to the sidewalls 5 of the head. The pocket former is shown positioned at an arbitrary position along the length of the head.

FIG. 3. ½ scale. Pocket former is shown placed in a lacrosse stick head viewed from the front (wide) end of the head. Ends of the crosspiece 4 are shown placed under the sidewalls 5 and the form is shown screwed down against the lacing 6 (dotted lines) to form a pocket of desired depth.

FIG. 4. ½ scale. Side view of pocket former placed in a lacrosse stick head 5 at a somewhat forward position in the head, and screwed down against the lacing 6 to form a pocket at a forward position.

FIG. 5. ½ scale. Side view of pocket former placed in a lacrosse stick head 5 at a rear position in the head, and screwed down against the lacing 6 to form a rear pocket. At this rear position, the head is narrower, and the use of a shorter crosspiece 4A (see FIG. 6) is more convenient.

FIG. 6. ½ scale. Interchangeable shorter 4A and longer 4B crosspieces for forming a pocket, at the narrow (rear) end of a head (see FIG. 5), or in the wider goalie's head, respectively.

SUMMARY

The device consists of a convex form (for example, a hemisphere of radius similar to that of a lacrosse ball), a bracing mechanism (for example, a straight tapered bracing crosspiece) that engages the sidewalls of a lacrosse stick head mid a connecting mechanism that connects said bracing mechanism to said forming shape. The connecting mechanism contains a means (for example, a screw) for varying the spacing between the forming shape and the bracing mechanism. The bracing mechanism contains a variable means (for example, interchangeable bracing crosspieces of various lengths) for causing the bracing mechanism to engage opposite sidewalls of heads of various widths.

DETAILED DESCRIPTION

Figure 1:
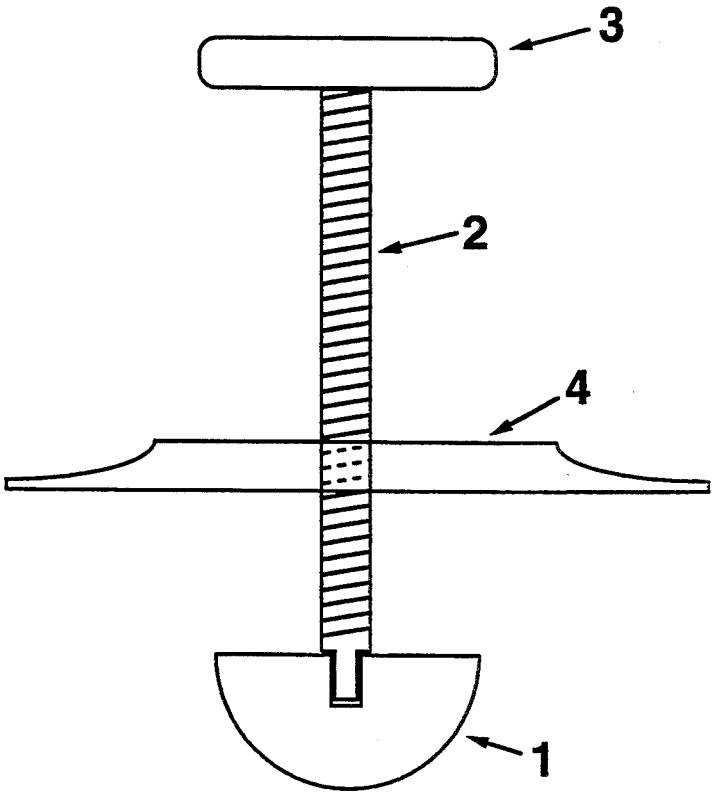

A typical embodiment of the pocket forming device of the present invention is shown in FIG. 1. Construction is of any material of appropriate strength and stiffness. The device consists of a convex form 1 (in this embodiment, a solid hemisphere of radius similar to a lacrosse ball) attached to one end of a connecting mechanism (in this embodiment, a threaded screw shaft) 2, detachable attached to the convex form. The connecting mechanism may be of any length that permits thrusting the form against the strings to the desired depth. The connecting mechanism is attached to the form is such a way that it can be easily removed to interchange or replace various parts of the device; in this embodiment, the connecting mechanism is machined at one end to fit into a hole in the back face of the form (FIG. 1), in such a way that the form is held firmly on the end of the connecting mechanism, yet is removable by hand. In the case of a connecting mechanism that consists of a threaded shaft, the back of the forming shape may be drilled and tapped to accept the thread of the shaft, and the form may be screwed onto the shaft and held firmly by friction. Other modes of attachment are also possible. The pitch on the threaded shaft is approximately 8 threads/inch, but may be any convenient pitch. A knob, 3 is affixed to the other end of the shaft. A bracing mechanism—in this embodiment, a bracing crosspiece 4 of rectangular cross section and with tapered ends—is drilled and tapped to accept the thread of the shaft so as to allow the shaft to screw easily through the crosspiece when the knob 3 is twisted by hand. The bracing mechanism and form can each be of any of a range of sizes, but the dimensions of the bracing mechanism and the form are such that when the device is assembled, the form can be thrust to a depth in the stringing less than the maximum depth prescribed by lacrosse rules (one ball diameter). The length of the bracing mechanism is long enough to reach across the width of the lacrosse stick head, but not so long as to impede inserting both ends of the bracing mechanism through the stringing on opposite sides of the head. Accordingly, the bracing mechanism may be variable in length (for example, by a telescoping mechanism) to accommodate lacrosse stick heads of various widths.

Figure 2:
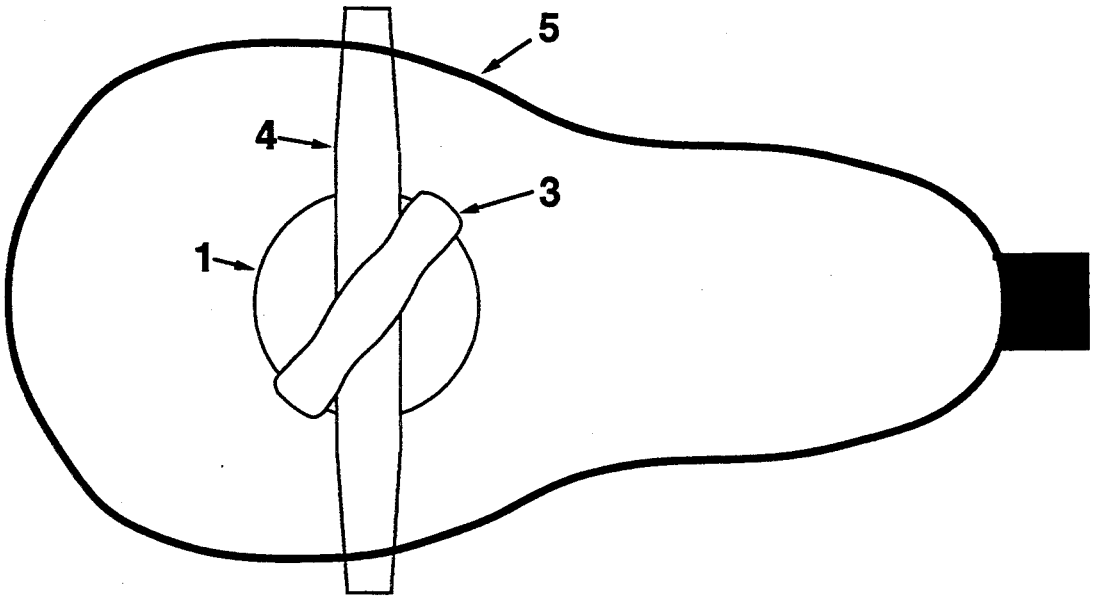
Figure 3:
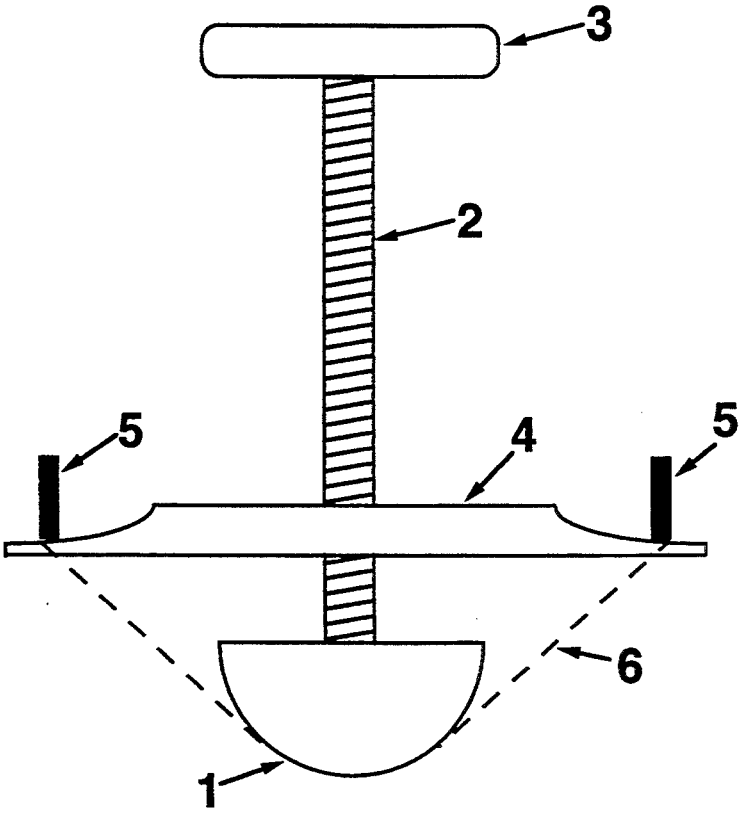
Figure 4:
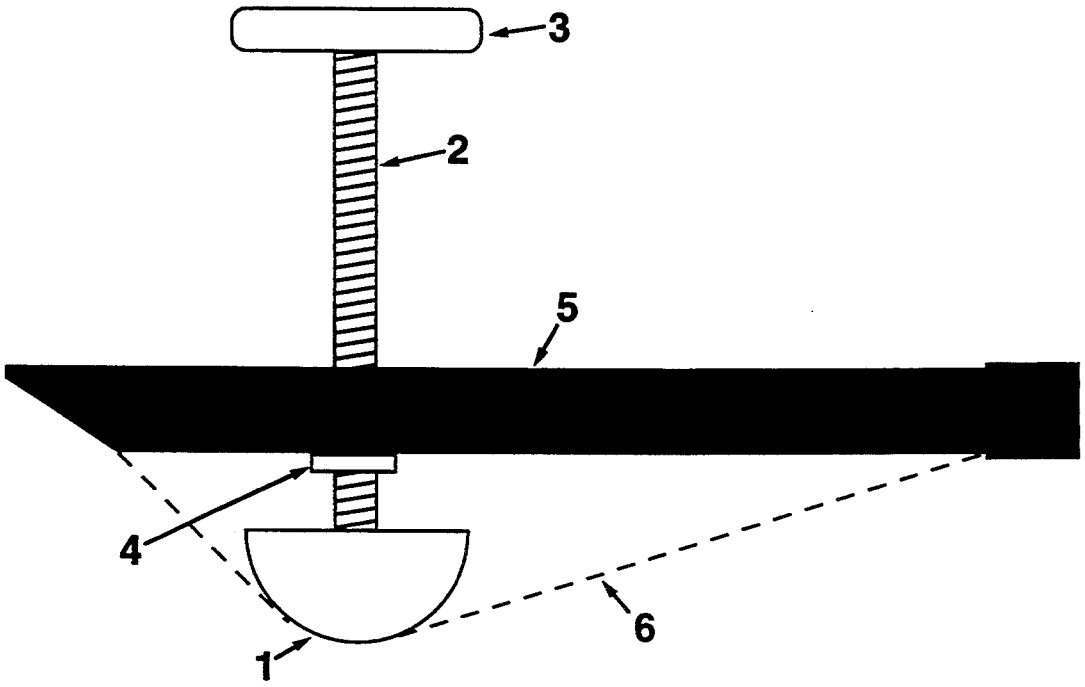
Figure 5:
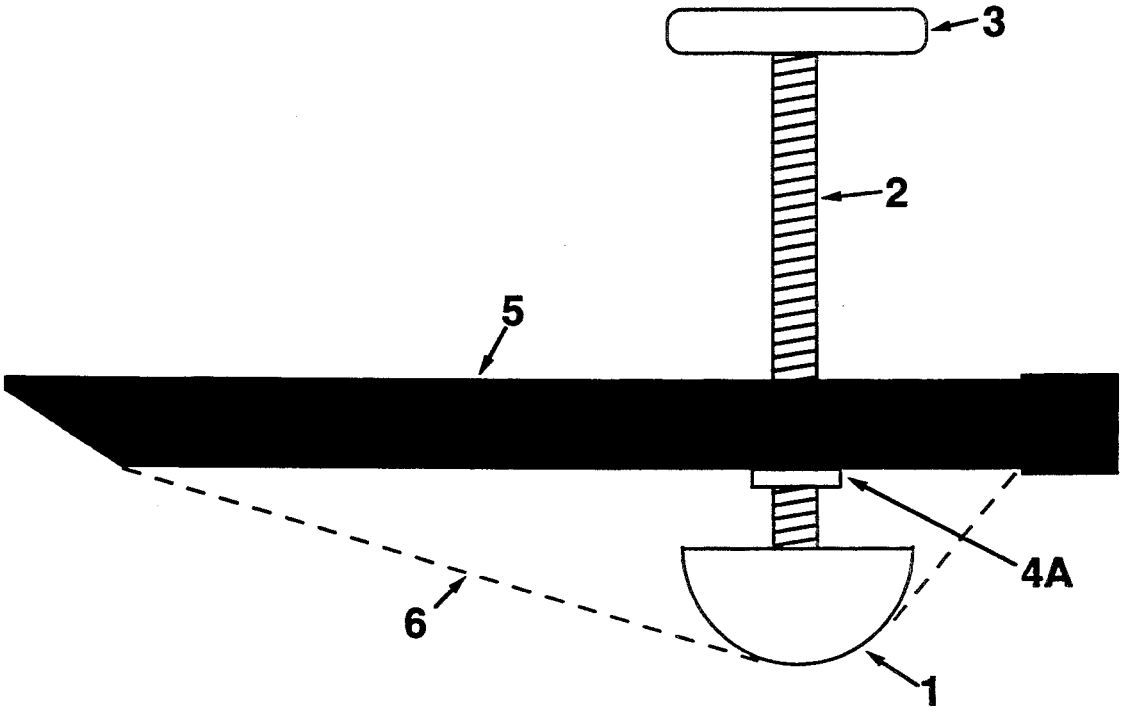
Figure 6:
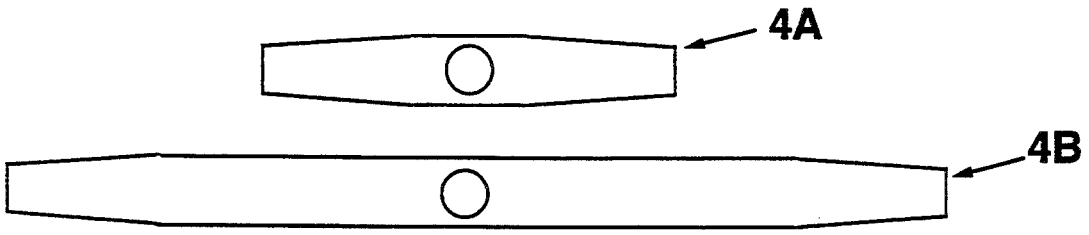

The pocket former is used as follows: The ends of the bracing mechanism are individually inserted between the webbing and the lacrosse stick head so that each end of the bracing mechanism protrude over and rest against opposite sidewalls of the head, and the form is forced against the stringing to set the desired pocket depth by screwing the threaded shaft through the bracing mechanism. Pressure can be maintained indefinitely, owing to the fact that the tension of the stringing is balanced by the crosspiece ends braced against the underside of the sidewalls. The pocket may be formed in a forward position (wider part) of the head (FIGS. 2, 3 and 4), or at a more rearward position (FIG. 5), where the head is narrower, by using the appropriate length of crosspiece 4, or 4A, FIG. 6, respectively). The crosspieces 4, 4A, and 4B are interchanged by removing the form by hand, screwing off one crosspiece and screwing on another, and replacing the form. The pocket former is removed for play.

CONCLUSION, RAMIFICATION AND SCOPE OF THE INVENTION

Thus, the lacrosse stick pocket former is a small, convenient device for forming and maintaining a pocket in the lacrosse stick stringing, and is, in fact, the first such device specifically designed for this purpose. The invention represents a significant advance over prior art, since it provides, in one small, self-contained device, vastly improved functionality over that previously supplied by the use of miscellaneous objects such as a balls, weights, and sticks to press a pocket in stringing. This improved functionality is chiefly derived from the device's provisions for precisely regulating the position and depth of the pocket, and hence reliably producing a pocket of desired characteristics. The above specification is not intended to represent the only possible embodiment of the invention, but merely one example thereof. Other possible embodiments include: forms with shapes other than a hemisphere; a hollow form; ratchet-based adjustment mechanisms instead of the screw; other bracing mechanisms, for example, consisting of spring-loaded wing-like hooks; various alternative methods for reversibly attaching the form to the bracing mechanism. The material of construction can be metal, plastic or wood, or various appropriate combinations of materials, and the method of fabrication can involve molded or machined parts.

I claim:

1. A device for forming and maintaining a pocket in the stringing of a lacrosse stick head comprising:

(a) a convex form and (b) a bracing mechanism that engages the sidewalls of a lacrosse stick head and (c) a means for connecting said bracing mechanism to said convex form.

2. The device of claim 1, wherein said convex form further comprises a hemisphere of radius approximately equal to that of a lacrosse ball.

3. The device of claim 1 wherein the dimensions of said convex form, connecting means and bracing mechanism are such that when the device is assembled and positioned in the lacrosse stick head, the resulting pocket will be formed to a depth no greater than that prescribed by lacrosse rules.

4. The device of claim 1, wherein said connecting means further comprises means for adjusting the space between the convex form and the bracing mechanism.

5. The device of claim 4, wherein said means for adjusting the space between the convex form and the bracing mechanism further comprises a screw shaft threaded through a tapped hole in the bracing mechanism.

6. The device of claim 5 wherein the length of the treaded portion of said screw shaft is limited so that the resulting pocket will be formed to a depth no greater than that prescribed by lacrosse rules.

7. The device of claim 5 wherein said screw shaft is detachable attached to the convex form.

8. The device of claim 5 further comprising a knob on the end of the screw shaft opposite to said convex form.

9. The device of claim 1 wherein said bracing mechanism further comprises a straight bracing crosspiece of suitable size and shape to permit engaging the sidewalls by inserting the ends of said crosspiece between the sidewalls of the head and the stringing.

10. The device of claim 9 wherein said crosspiece further comprises means for adjusting the length of said crosspiece to accommodate various spacing between the sidewalls.

11. The device of claim 9 wherein said means for adjusting the length of said crosspiece to accommodate various spacing between the sidewalls further comprises a plurality of crosspieces of various lengths, said crosspieces being detachable attached to connecting means to accommodate various spacing between the sidewalls and the head.

12. A method for forming a pocket in a lacrosse stick head using the device of claim 1 comprising:

(a) individually inserting each end of the bracing mechanism of the device of claim 1 through said stringing, (b) positioning said device with the ends of the bracing mechanism protruding under and resting against opposite sidewalls of said head, (c) forcing the convex form into contact with said stringing.

13. A device for forming and maintaining a pocket in the stringing of a lacrosse stick head comprising:

(a) a convex form, (b) a screw shaft detachable attached at one end to said convex form, (c) a bracing mechanism with a tapped hole for accepting the screw shaft, and (d) a knob attached to the screw shaft at the opposite as the convex form.

* * * * *